US006483778B1

(12) United States Patent
Pozzo et al.

(10) Patent No.: US 6,483,778 B1
(45) Date of Patent: Nov. 19, 2002

(54) SYSTEMS AND METHODS FOR PASSIVELY COMPENSATING TRANSDUCERS

(75) Inventors: William M. Pozzo, North Easton, MA (US); John C. Cochran, Porstmouth, RI (US); John G. Hanley, Narragansett, RI (US); James Floor, Tiverton, RI (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/285,135

(22) Filed: Apr. 2, 1999

(51) Int. Cl.[7] ..... H04R 9/02
(52) U.S. Cl. ..... 367/172; 367/175; 367/182
(58) Field of Search ..... 367/167, 172, 367/182, 175; 310/337; 381/190

(56) References Cited

U.S. PATENT DOCUMENTS

| | | | | |
|---|---|---|---|---|
| 3,760,346 A | | 9/1973 | Donovan et al. | |
| 4,001,765 A | * | 1/1977 | Sims | 367/172 |
| 4,432,077 A | | 2/1984 | Alhilali et al. | 367/31 |
| 4,466,083 A | * | 8/1984 | Willard et al. | 367/175 |
| 4,674,067 A | | 6/1987 | Zemanek, Jr. | 367/25 |
| 4,695,987 A | | 9/1987 | Bouyoucos | 367/143 |
| 4,763,307 A | * | 8/1988 | Massa | 367/175 |
| 4,768,616 A | | 9/1988 | Richard et al. | 181/233 |
| 4,868,799 A | * | 9/1989 | Massa | 367/172 |
| 4,926,398 A | * | 5/1990 | Fincher | 367/172 |
| 4,982,385 A | | 1/1991 | Eynk | 367/151 |
| 5,062,089 A | | 10/1991 | Bernard et al. | |
| 5,321,667 A | | 6/1994 | Audi et al. | |
| 6,046,962 A | * | 4/2000 | Suppa et al. | 367/172 |

FOREIGN PATENT DOCUMENTS

| | | |
|---|---|---|
| EP | 0 881 001 A | 12/1998 |
| GB | 1 532 008 A | 11/1978 |

OTHER PUBLICATIONS

Report No. HA 112–80, "Phase II Qualification Test Report Engineering Prototype Low Frequency Underwater Source", Hydroacoustics Inc., Mar. 31, 1980.

* cited by examiner

*Primary Examiner*—Ian J. Lobo
(74) *Attorney, Agent, or Firm*—Foley Hoag LLP

(57) ABSTRACT

Systems and methods of the invention can equalize the pressure between an interior cavity and an environment exterior to the interior cavity, while providing for acoustic isolation between the two environments so that acoustic energy propagating through one environment does not cause acoustic vibrations in the other environment. In one application, these pressure compensation systems are employed to equalize the pressure on either side of a moving coil projector, thereby reducing the deleterious effect that a pressure differential across the moving coil projector can have on the operation of the moving coil projector and reducing the likelihood that propagating acoustic energy can result in phase cancellation that reduces the acoustic performance of the moving coil projector.

18 Claims, 4 Drawing Sheets

SYSTEMS AND METHODS FOR PASSIVELY COMPENSATING TRANSDUCERS

This invention was made with Government support under Contract No. N00024-96-C-6106 awarded by the Department of the Navy. The Government has certain right in this invention.

FIELD OF THE INVENTION

The invention relates to systems and methods for maintaining an active element at a selected bias point, and more particularly, to systems and methods that passively compensate moving coil transducers to compensate for pressure fluctuations.

BACKGROUND OF THE INVENTION

A moving coil transducer for underwater applications is similar to a loudspeaker in that it is designed with a very soft suspension system to provide a low natural resonant frequency. Because of this soft, structurally compliant suspension system, a pressure compensation system is required to keep the forces acting on the moving radiating piston in static equilibrium. By equalizing the interior pressure to the exterior pressure, the radiating piston will maintain its neutral position. It is essential that a neutral position for the radiating piston be maintained because of mechanical limitations associated with alignment of the radiating piston with the magnetic driver. Large excursions from a neutral position will cause the piston to exceed the boundary of the applied magnetic field with an associated reduction in output power and an increase in distortion. A typical maximum pressure imbalance of only .15 psi acting on the radiating piston is allowed for these types of transducers. Pressure equalization must be maintained as the exterior hydrostatic pressure is both increased and decreased.

Until now, these types of transducers have used pressurized gas in back of the radiating piston to equalize the interior transducer pressure to the exterior hydrostatic pressure acting on the front of the radiating piston. For applications at shallow depths, this can be accomplished easily by using a gas filled bladder. As the hydrostatic pressure increases, the bladder compresses under the hydrostatic load. The compressed bladder decreases the interior volume of gas. As the volume of gas decreases, the pressure increases. Pressure equilibrium is obtained when the bladder has compressed sufficiently such that the interior pressure is equal to the exterior pressure. This method is called a "Passive Gas Compensation System." It is not practical for applications at deeper depths because the size of the bladder becomes prohibitively large.

Traditionally, for deeper depths, this type of transducer has employed a different method of gas compensation which injects high pressure gas into the interior of the transducer. This method of gas compensation is referred to as an "Active Gas Compensation System." This type of compensation system is very complex because it requires a method to sense the interior and exterior pressures and control the addition of high pressure gas to the interior of the transducer and the exhaust of this gas from the transducer. This method of gas compensation also requires that high pressure gas be carried as part of the transducer system. High pressure gas containment and associated plumbing is a safety hazard. In addition, because the gas is exhausted and not recovered, the mission life for this type of system is very limited. This is particulary troublesome for systems such as the Mk30 Mod 2 Target Undersea Vehicle (TUV) system that has only a small allocated volume for transducer components. Consequently, this type of gas compensation system would greatly limit the mission life of the Mk30 Mod 2 TUV system. The vehicle would have to be brought to the surface frequently and the high pressure gas replenished. Another disadvantage of this type of system is that, although the gas provides pressure equalization for the radiating piston, the compliance of the gas decreases as the inverse square of the absolute pressure of the gas. Hence, as the system changes operating depth, the compliance of the suspension systems changes and the resonant frequency of the system will change. As the transducer is lowered to greater depths, the resonant frequency will increase considerably as the compliance of the gas behind the piston decreases. The hazards of handling high pressure gas containment systems, the requirements for replenishment of the gas supply, and the changing performance of the transducer make the Active Gas Compensation System a very unattractive, unreliable compensation system.

SUMMARY OF INVENTION

The systems and methods described herein can equalize the pressure between an interior cavity and an environment exterior to the interior cavity, while providing for acoustic isolation between the two environments so that acoustic energy propagating through one environment does not cause acoustic vibrations in the other environment. In one application, these pressure compensation systems are employed to equalize the pressure on either side of a moving coil projector, thereby reducing the deleterious effect that a pressure differential across the moving coil projector can have on the operation of the moving coil projector and reducing the likelihood that propagating acoustic energy can result in phase cancellation that reduces the acoustic performance of the moving coil projector.

In one embodiment, the systems include pressure compensation devices for use with a transducer assembly that has a moving coil and a diaphragm. The pressure compensation device can include a housing having an interior cavity capable of being filled with fluid and dimensioned for receiving and enclosing the moving coil of the transducer assembly. A resilient bladder can be disposed within the housing and can have a first portion in communication with an operating environment and a second portion in communication with a fluid reservoir maintained within the housing. An acoustic filter can couple to the fluid reservoir and attenuate acoustic energy propagating at selected frequencies within the fluid reservoir, and a fluid passage can extend between the fluid reservoir and the interior cavity, whereby a pressure change in the operating environment acts on the resilient bladder and is communicated through the fluid reservoir and the fluid passage to adjust the pressure within the interior cavity.

In a further embodiment, the apparatus can include a compressible body disposed within the interior cavity. The compressible body can compress or expand in response to the movement of the projector within the cavity. The compressible body can be a slotted cylinder, a spring assembly, such as a belleville spring assembly or any other device capable of performing as a spring. In one embodiment the compressible body is an air filled compliant disk assembly capable of being compressed in response to a change in pressure within the interior cavity. The compliant disk assembly can also comprise a plurality of bladders filled with a compressible gas capable of being compressed in response to a change in pressure within the interior cavity.

In one embodiment, the filter can comprise a conduit coupled between the fluid reservoir and the interior cavity and having an interior passage for forming the fluid passage extending therebetween, and being dimensioned for resisting transmission of acoustic energy at selected frequencies between the interior cavity and the exterior environment.

The fluid passage can include a conduit coupled between the fluid reservoir and the interior cavity and dimensioned to allow fluid to pass at a rate selected as a function of the rate of pressure change of the operating environment.

The housing can comprise a body having a mass selected to resist vibration at selected frequencies, as well as a support rim for mounting to the transducer assembly.

The housing can also include a mounting rim for allowing the housing to be removeably and replaceably mounted to a surface.

In another aspect, the systems described herein include a modular moving coil transducer having pressure compensation for adjusting to pressure changes in an operating environment. The transducer can include a transducer assembly having a moving coil and a diaphragm, a housing having a fluid-filled interior cavity enclosing the moving coil to the transducer assembly, and having a resilient bladder disposed between the operating environment and a fluid reservoir maintained within the housing and being capable of deforming in response to a pressure change in the operating environment, a filter coupled to the fluid reservoir and capable of attenuating acoustic energy propagating at selected frequencies within the fluid reservoir, and a fluid passage extending between the fluid reservoir and the interior cavity, whereby a pressure change in the operating environment acts on the resilient bladder for being communicated through the fluid reservoir and the fluid passage to adjust the pressure within the interior cavity.

The transducer can also include a compressible body disposed within the interior cavity, as well as a complaint disk assembly capable of being compressed in response to a change in pressure within the interior cavity. The filter can comprise a conduit coupled between the fluid reservoir and the interior cavity and having an interior passage for forming the fluid passage, and being dimensioned for resisting transmission of acoustic energy at selected frequencies between the fluid reservoir and the interior cavity. The fluid passage includes a conduit coupled between the fluid reservoir and the interior cavity and dimensioned to allow fluid to pass at a rate selected as a function of the rate of pressure change of the operating environment.

The systems can also include target underwater vehicles capable of ascending and descending to different depths within a fluid environment, comprising a submersible body having a sidewall with a port for receiving a transducer assembly, and a modular transducer assembly mounted within the port, and having a moving coil projector including a moving coil and a diaphragm, a housing having a fluid-filled interior cavity enclosing the moving coil, and having a resilient bladder disposed between the fluid environment and a fluid reservoir maintained within the housing, a filter coupled to the fluid reservoir and capable of attenuating acoustic energy propagating at selected frequencies within the fluid reservoir, and a fluid passage extending between the fluid reservoir and the fluid-filed interior cavity, whereby a pressure change arising from a change in depth within the fluid environment acts on the resilient bladder to communicate the pressure change through the fluid reservoir and the fluid passage to adjust the pressure within the interior cavity.

Other objects of the invention will, in part, be obvious, and, in part, be shown from the following description of the systems and methods shown herein.

BRIEF DESCRIPTION OF THE DRAWINGS

The foregoing and other objects and advantages of the invention will be appreciated more fully from the following further description thereof, with reference to the accompanying drawings wherein.

DETAILED DESCRIPTION OF THE ILLUSTRATED EMBODIMENTS

To provide an overall understanding of the invention, certain illustrative embodiments will now be described, including a moving coil transducer with passive pressure compensation. However, it will be understood by one of ordinary skill in the art that the passive compensation systems described herein can be adapted and modified to provide pressure compensation for other devices and processes that can benefit from the reduced size and reduced complexity achieved by the pressure compensation systems described herein. Moreover, it will be apparent to one of ordinary skill in the art that numerous additions and modifications can be made to the depicted systems and methods without departing from the scope of the invention.

The systems and methods described herein provide passive compensation systems that can equalize the pressure within an interior cavity to that of the ambient pressure outside the cavity. In the illustrated embodiments, the pressure compensation systems are employed with moving coil transducer assemblies that are projecting a signal, such as an acoustic signal, into an operating environment that has variable pressure. It is understood that for proper operation, the moving coil transducer should operate in an environment of substantially uniform pressure. Thus, improved transducer performance can be achieved by reducing or eliminating pressure gradients or pressure differentials that exist in the area in which the transducer is moving. This equalization of pressure reduces or eliminates the deleterious effects on transducer performance that can arise when one side of the moving transducer is subjected to a force created by a pressure being applied to one side of the transducer. Additionally, the systems described herein integrate acoustic filters into the passive compensation systems to reduce or eliminate the transfer of acoustic energy from the environment within the interior cavity to the ambient environment. Thus, the passive pressure compensation systems described herein equalize the pressure within an interior cavity that houses the moving coil of the moving coil transducer to that of the operating environment on which the moving coil is acting, without introducing phase cancellation effects that can arise from the transfer of acoustic energy from operating environment to the environment in which the transducer is moving.

Figure 1:
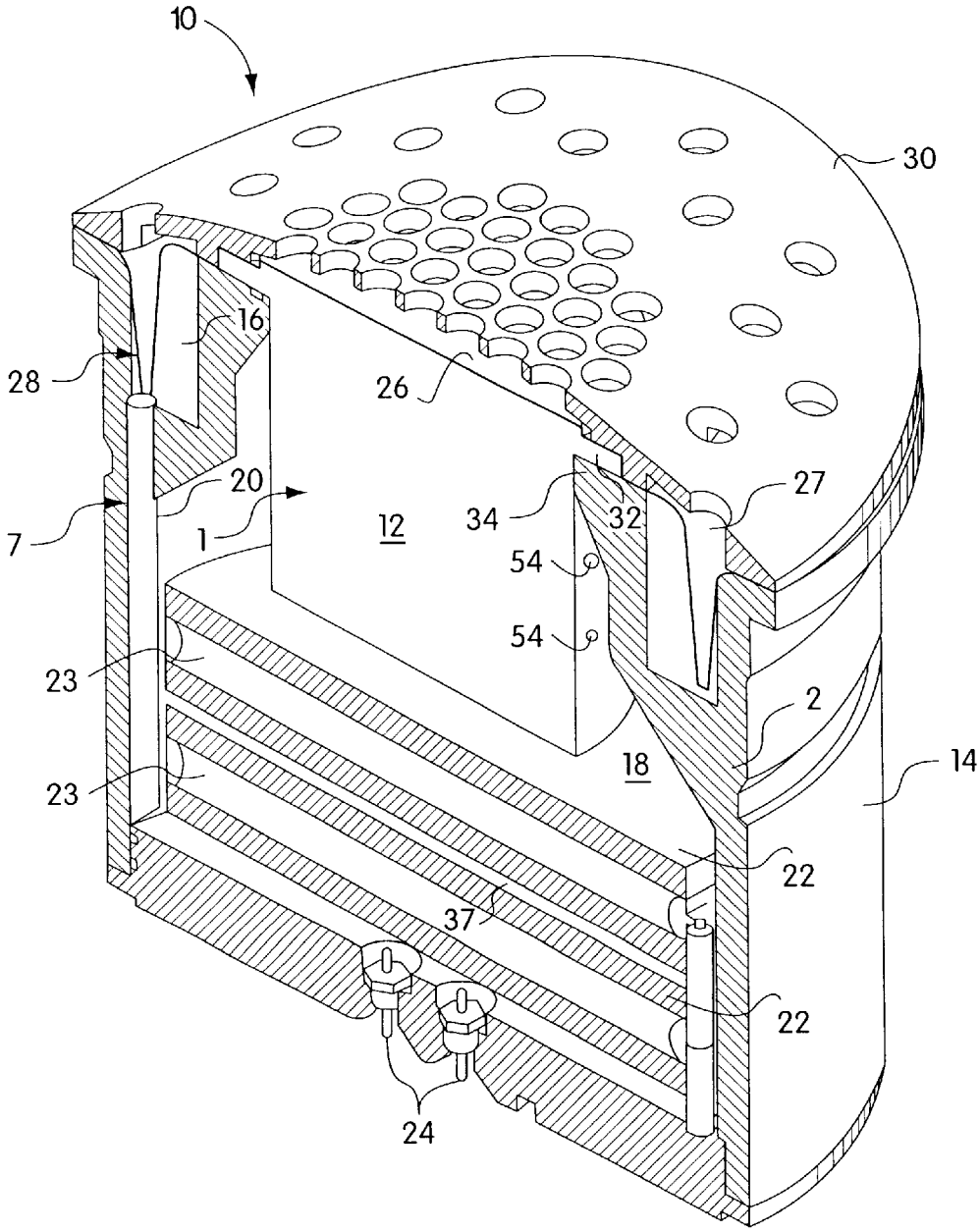
FIG. 1 depicts one transducer assembly having a passive compensation system.

FIG. 1 depicts a first embodiment of a transducer that includes a passive compensation system according to the invention. Specifically, FIG. 1 illustrates a transducer assembly 10 having a moving coil projector assembly 12, a housing 14, a fluid reservoir 16, an interior cavity t8, a fluid passage 20, a pair of compressible disk assemblies 22, filled with gas 23, a pair of electrical connections 24, a resilient bladder 28, and an apertured cover 30.

The depicted assembly 10 includes the moving coil projector 12 that is partially enclosed within the interior cavity 18 of the housing 14, with one side 26 of the moving coil projector 12 being disposed exterior to the cavity 18. The apertured cover 30 mounts to the peripheral rim of the housing 14 and provides a protective plate that covers the exposed side 26 of the moving coil projector 12. The fluid reservoir 16 and the interior cavity 18 can be filled with a non-compressible liquid such as Polyalkylene Glycol.

Figure 2:
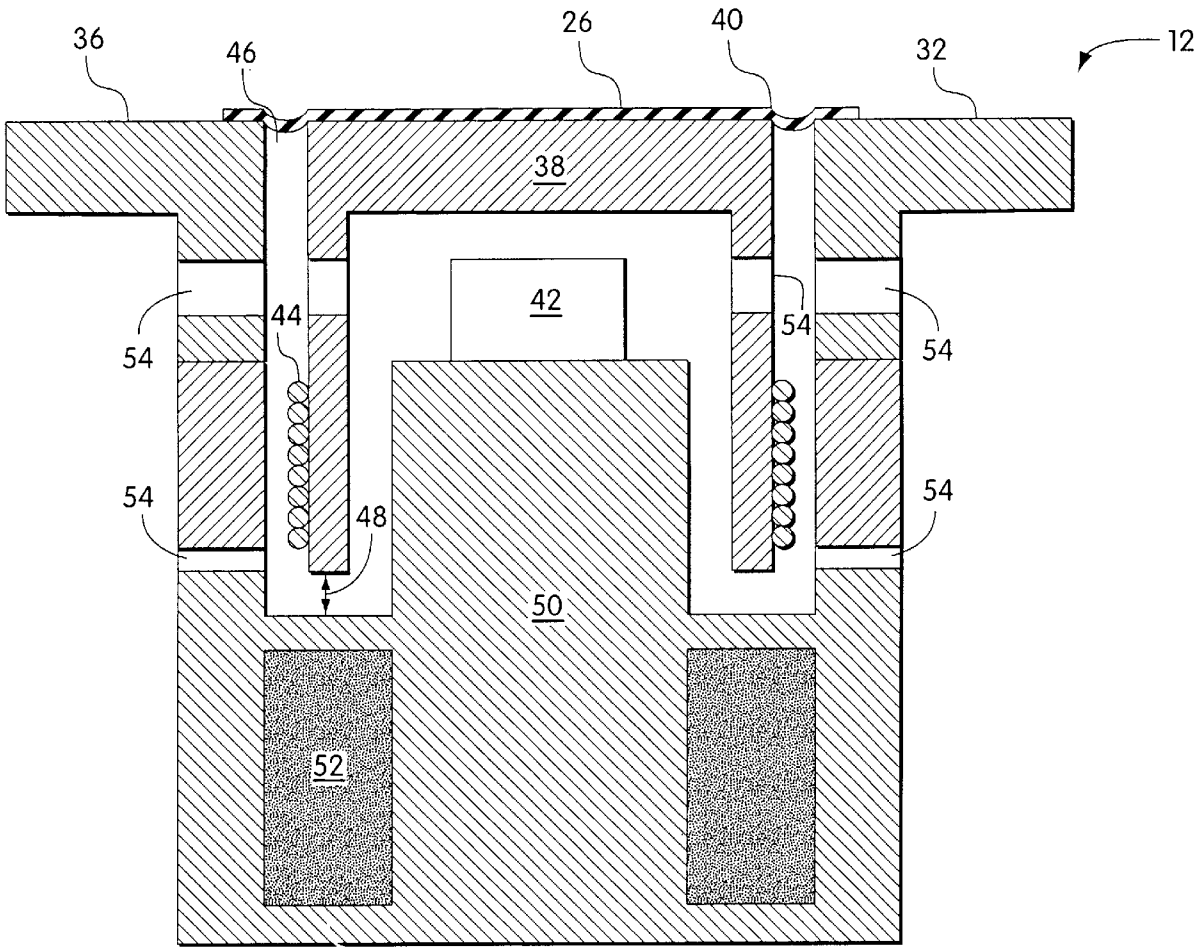
FIG. 2 depicts in greater detail the moving coil projector of FIG. 1.

FIG. 2 depicts in greater detail one moving coil projector 12 suitable for use within the system depicted in FIG. 1. The depicted moving coil projector 12 is a conventional moving coil driver assembly, such as the type manufactured and sold by Argotec of Ft. Lauderdale, Fla. and can be for example the Argotec MOD 215 Rare Earth Projector. As depicted in FIG. 2, the moving coil projector 12 includes a mounting flange 32 that butts against and mounts to a mounting rim 34 of housing 14. The mounting rim 34 can include a peripheral gasket (not shown) for sealing against the mounting flange 32, thereby providing a fluid tight seal between the moving coil projector 12 and the housing 14.

The cross-sectional view of FIG. 2, shows that the moving coil projector 12 includes a moving piston 38, a diaphragm 40, a mechanical stop 42, a coil 44, magnetic poles 50, permanent magnet 52, and fluid ports 54. As illustrated, the housing 36 of the moving coil projector 12 has a piston cavity 46 that is closed at one end by the diaphragm 40. The diaphragm 40 seals about the perimeter of the piston cavity 46 and attaches to the upper surface of the moveable piston 38. The diaphragm 40 can be formed of a resilient material, such as rubber, and thereby act as a suspension member that holds the moving piston 38 within the piston cavity 46 while allowing the moveable piston 38 to rise and fall within the piston cavity 46.

As further depicted by FIG. 2, the moveable piston 38 has at one end a coil 44 formed from a plurality of windings of an electrically conductive material, such as copper wire. The depicted coil 44 is adjacent to the permanent magnets 52. The permanent magnets 52 create a DC magnetic field that acts on the coil 44. The coil 44 can couple to an AC current generator (not shown) to provide an AC current to the coil 44. The electromagnetic fields provided by the AC current and the permanent magnets 52 interact to generate an AC force in a direction orthogonal to the AC current. The generated force applied to the coil 44 moves the piston 38 proportional to the strength of the DC magnetic field, the length of wire exposed to the DC magnetic field, and the magnitude of the current in the wire. The magnitude of the movement of moveable piston 38 is, in part, bounded by the mechanical stop 42 that is positioned below one surface of the moveable piston 38 and by the resilient diaphragm 40 that couples the moveable piston 38 to the housing 36 and the cover plate 30. To this end, the mechanical stop 42 can be formed of a resilient material that reduces the likelihood of damage to the moving piston 48 arising from contact with surfaces of the housing 36. For the depicted embodiment, the movement of the moveable piston 38 is therefore limited by the air gap between the housing 36 and the moveable piston 38.

FIG. 2 further depicts that the moving coil projector 12 has a plurality of fluid ports 54 that place the piston cavity 46 into fluid communication with the exterior of the housing 36. Specifically, FIG. 2 depicts fluid ports 54 that extend through the housing 36 for allowing fluid to pass from the exterior of the housing 36 into the piston cavity 46. FIG. 2 further shows that the depicted moveable piston 38 has apertures 54 extending therethrough which further act as fluid ports for allowing fluid to communicate into any voids or spaces that are interior to the moveable piston 38.

Returning to FIG. 1, it can be seen that the fluid ports 54 place the projector. cavity 46 in fluid communication with the interior cavity 18 and thereby allow fluid to flow from the interior cavity 18 into the projector cavity 46 of the moving coil projector 12. Accordingly, the fluid within the interior cavity 18 can flow in and out of the moving coil projector 12 to equalize, or substantially equalize the fluid pressure of the interior cavity 18 and of the projector cavity 46 (shown in FIG. 2). As discussed above, the fluid within the cavity 18 and the projector cavity 46 can be any suitable non-compressible fluid such as oil or Polyalkylene Glycol.

Disposed beneath the moving coil projector 12 are two compliant disk assemblies 22. The compliant disk assemblies 22 provide compressible bodies within the interior cavity 18 that can compress or expand in response to pressure changes within the interior cavity. Accordingly, the compliant disk assemblies 22 provide a compliant backing for the moving coil projector 12. For example, during the generation of low frequency signals of significant acoustic power, the moving coil projector 12 will drive the piston 38 and diaphragm 40 to displace the diaphragm significant distances about the designed quiescent point of the projector 12. To generate these large displacements, the transducer assembly 10 includes the compliant disk assemblies 22 within the interior cavity 18 to provide a soft or compliant back for the moving piston 38. The compliant disk assemblies 22 can expand or contract in volume to respond to pressures applied by the moving coil projector 12 and transmitted to the compliant disk assemblies 22 by the incompressible fluid that fills the interior cavity 18. The volumetric response of the compliant disk assemblies 22 provides a compliant backing for the moving coil projector 12 that allows the projector 12 to move freely, even when fluid pressure within the interior cavity is at the maximum expected operating pressure.

The depicted compliant disk assemblies 22 are sized to fit within the interior cavity 18, with enough space between the sidewall of the housing 14 and the disk assemblies to allow for the fluid in the cavity 18 to surround the disk assemblies 22. In the depicted embodiment, the compliant disk assemblies 22 are spaced apart from each other to define a gap 37 between the two compliant disk assemblies 22 that can fill with fluid.

Figure 3:
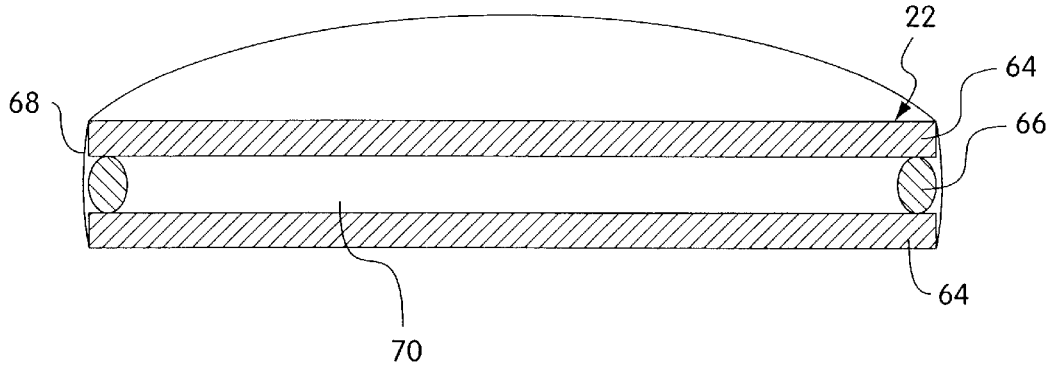
FIG. 3 depicts in greater detail one of the compliant disk assemblies of FIG. 1.

Each compliant disk assembly 22, as illustrated by FIG. 3 can include two plates 64 which are mounted to a collar 66 that spaces apart the plates 64. A coating 68 is applied around the plates 64 and the collar 66 to form an integral unit that acts as a compliant disk that can flex inwardly and outwardly in response to a force applied to the plates 64. In one embodiment, each of the plates 64 is formed of fiberglass, and the collar 66 is formed of a tubular aluminum ring. The plates 64 are seated against the collar 66 and covered by a coating 68 of butyl rubber. The coating 68 seals the compliant disk assembly 22 thereby preventing fluid from entering into the interior chamber 70 that is defined by the plates 64 and the collar 66. The interior chamber 70 can be filled with a compressible gas, such as air.

The rigidity of each of the plates 64 can be selected according to the specifications of the application, and typically are selected to be sufficiently resilient or compliant to flex in response to all forces that may occur within the selected range of operation of the moving coil projector 12. Thus, the plates 64 should flex in response to any force expected to be generated by the projector 12 during generation of an acoustic signal. It is further noted that the plates 64 will flex in response to forces resulting from increases or decreases in the fluid pressure within the interior cavity 18. To allow the compliant disk assemblies 22 to act as compliant backing for the moving coil projector 12 over the expected range of fluid pressures, in one embodiment, the collar 66 is dimensioned to space apart the plates 64 a distance sufficient to require a pressure that is greater than the maximum expected operating pressure before the plates 64 will flex inwardly and contact each other. In one embodiment, the plates 64 are spaced a distance sufficient to prevent the plates 63 from touching until 110% of the expected maximum pressure is reached in the cavity 18. It is noted that improved operation of the assembly 10 is achieved by employing plates 64 that provide a linear, or substantially linear, compliance or change in volume per unit change in acoustic pressure over the entire range of operating hydrostatic pressures. Testing has shown that plates 64 formed of fiberglass have achieved nearly linear compliance over the operating hydrostatic pressure range. In addition, improved operation is expected if the plates 64 resonate at frequencies out of the transducer frequency band of the assembly.

In one embodiment, the plates 64 are about 7.65" in diameter and about 0.320" thick. The plates are formed of fiberglass, such as E-glass or S-glass. Alternatively, the plates 64 could be formed of high strength steel, a graphite epoxy composite, titanium or any suitable material.

The number of compliant disk assemblies that are to be placed within the interior cavity 18 of the system 10 depends, in part, on the desired low frequency performance expected from the system. The location and sizing of the disk assemblies are understood to affect the performance of the transducer. Analysis and experiments have shown that an acceptable arrangement for the compliant disk assemblies 22 within the interior cavity 18 are as depicted in FIG. 1.

To further mitigate the effects of fluid pressure in the regions around the compliant disk assemblies 22 on the performance of the moving coil projector 12, an open cell mesh can be disposed within the interior cavity 18 to add a slight amount of acoustic loss to the system.

FIG. 1 further illustrates that the interior cavity 18 is in fluid communication with the fluid reservoir 16 via the fluid passage 20. The depicted fluid reservoir 16 is defined by an annular recess formed in the body of the housing 14. The fluid reservoir 16 is separate from the interior cavity 18. Accordingly, for fluid to pass between the fluid reservoir 16 and the interior cavity 18, the fluid is to pass through the fluid passage 20. In the embodiment depicted in FIG. 1, one fluid passage 20 is shown, however, other fluid passages 20 are provided which are not shown by the view provided in FIG. 1.

FIG. 1 further depicts a resilient bladder 28, that is disposed within the annular recess and sealed between the housing 14 and the cover 30., Surface 27, of the bladder 28 is exposed to the operating environment that is ambient to the system 10 by way of the apertures located in the cover 30. The opposite surface of the bladder is in contact with the fluid in the fluid reservoir 16. Accordingly, the bladder 28 acts as a compliant barrier that is disposed between the operating environment and the fluid reservoir 16. The depicted fluid reservoir 16 is in fluid communication with the fluid passage 20 that extends between the fluid reservoir 16 and the bottom of the interior cavity 18. The depicted bladder 28 can be formed from a resilient material, such as butyl rubber, neoprene, or any material that is sufficiently compliant to respond to pressure changes occurring in the operating environment on which the transducer is working.

The fluid passage 20 is formed as a conduit that extends between the fluid reservoir 16 and a lower portion of the interior cavity 18. The fluid passage 20 acts to place the fluid reservoir 16 into fluid communication with the interior cavity 18. The depicted fluid conduit 20 further acts as a filter for attenuating acoustic energy being passed through the fluid passage 20. To that end, the fluid passage 20 is formed as a tube that is sized and oriented within the housing to present a high acoustic impedance to acoustic energy propagating at frequencies in the bank of interest, The impedance is selected to be sufficiently high to prevent, or greatly reduce, acoustic leakage of the interior acoustic field to the exterior acoustic field at all frequencies within the frequency band of interest. Accordingly, the fluid passage 20 acts as a filter that isolates the internal and external acoustic fields such that no out-of-phase cancellation takes place. This, in turn, reduces the likelihood that phase cancellation will degrade the performance of the transducer assembly 10.

In the embodiment depicted in FIG. 1, a section of acoustic damping material is provided in the annular space between the disk assemblies 22. The acoustic damping material provides damping of resonances caused by fluid flow within the interior cavity 18. The acoustic damping material can be any material suitable for reducing the acoustic energy propagating with the interior cavity and can be for example, open cell or closed cell foam rubber, steel wool, or any mesh material that can dissipate energy to dampen high energy resonance.

As can be understood from the above description on of FIGS. 1–3, the pressure compensation system that is formed within the system 10 acts to equalize pressure between the interior cavity 18 and the operating environment that is exterior to the housing 14 and the apertured cover 30. It is understood that the equalization of pressure between the interior cavity 18 and the operating environment provides the greatest dynamic range for the moving coil projector 12, and thereby reduces the adverse effect on transducer performance that occurs when a mismatch exists between the pressure of the operating environment and the pressure of the environment in which movement of the moving coil occurs. To this end, it is noted that in operation movement of the moving coil 12 pushes and pulls fluid within the cavity 18. The fluid in cavity 18 acts on the compressible bodies 22 that are disposed within the interior cavity 18 and, in the depicted embodiment, below the moving coil projector 12. Each of the depicted bodies 22 is enclosed within the cavity 18 and surrounded by the fluid within the cavity. The compressible bodies 22 act as compliant disks that can yield and deflect inwardly in response to an increase in pressure within the cavity 18, such as an increase in pressure caused by a downward movement of the moveable piston 38. Accordingly, the. compliant disk assemblies provide a compliant backing that allows the coil to move freely within the system 10, even when the fluid pressure would, without the complaint backing, prevent movement of the projector.

Additionally, the fluid conduit 20 of the system 10 provides an acoustic filter that attenuates acoustic energy around the frequency of operation of the moving coil projector. This reduces or prevents feedback that can occur if the acoustic energy broadcast from the moving coil projector was to couple back through the bladder 28 and into the interior cavity 18. Such feedback can interfere with the oscillating projector 18 and diminish performance of the system.

The particular embodiment depicted in FIG. 1 can be approximately 10½" in height, and 10½" in diameter. The housing can be aluminum, steel or any suitable material.

Figure 4:
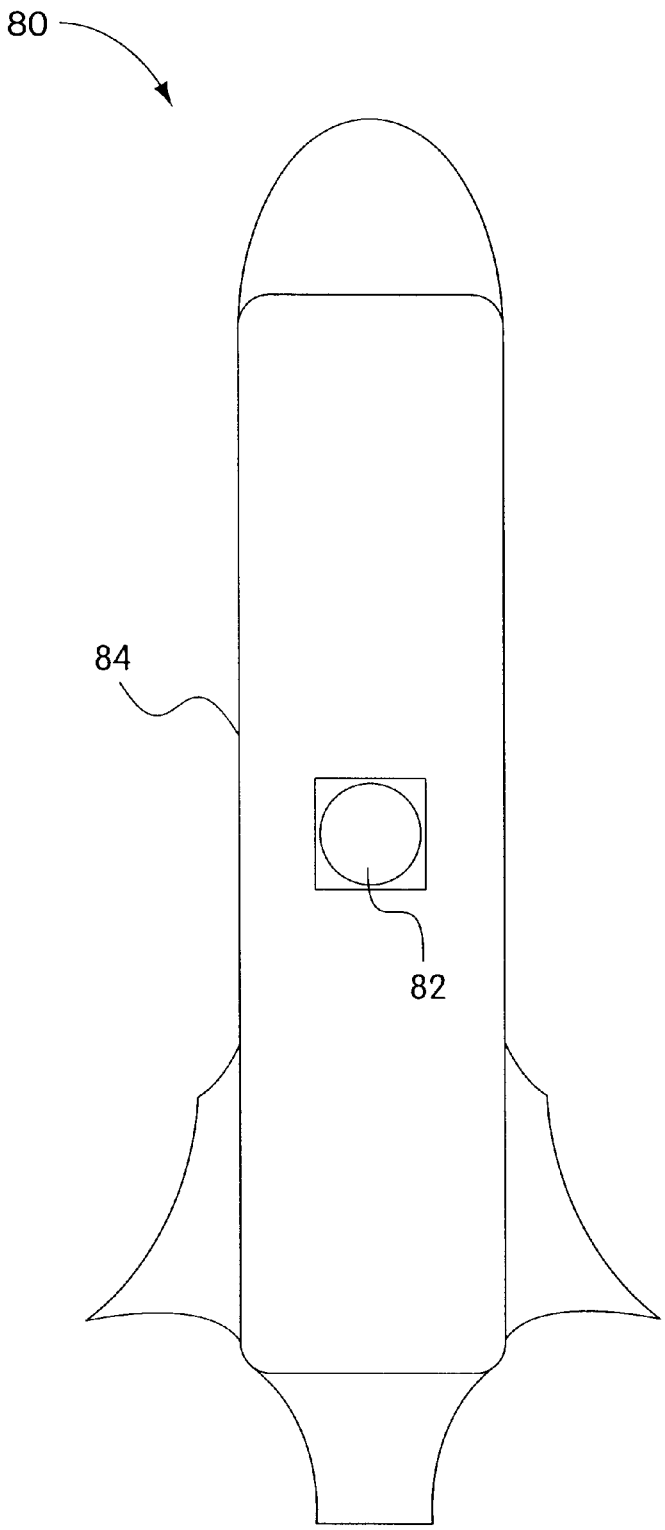
FIG. 4 depicts an underwater vehicle having a passively compensated moving coil transducer.

FIG. 4 depicts a submersible vehicle 80 having a transducer assembly with passive pressure compensation. Specifically, FIG. 4 depicts vehicle 80 that comprises a submersible body 84 having a port therein which is capable of receiving a modular transducer assembly having passive pressure compensation. As shown in FIG. 4 the body 84 has a sidewall in which the port is located. The transducer assembly 82 can be mounted into the side wall such that acoustic energy generated by the transducer 82 will be radiated therefrom and projected outward from the submersible body. In operation, as the submersible vehicle ascends and descends through the fluid environment, the pressure exerted by the fluid environment onto the transducer 82 will vary. As discussed above, the pressure changes will cause a force to be applied to the bladder 28 thereby compressing or decompressing fluid in the fluid reservoir 16. In the example where the submersible body 8 moved to an area of greater pressure, the fluid extending through the cover plate 30 and acting on the one surface of the bladder 28 will increase in pressure causing fluid in the internal reservoir 16 to be placed under greater pressure. This greater pressure will be communicated through the fluid passage 20 and into the fluid contained within the interior cavity 18. The fluid pressure within the interior cavity 18 is communicated into the piston cavity 46 of the moving coil projector 12. Accordingly, pressure within the interior cavity in which the moving coil projector operates is equalized to the pressure of the operating environment of the transducer assembly.

This above described system provides the compliance suited to maintain the hydrostatic pressure equilibrium across the head of the moving coil piston, all within the confines of the transducer. This passive mechanical compensation system requires no replenishment of materials and reduces or eliminates the need for maintenance as the compensation system is completely passive, requiring no active sensors or components. Additionally, the system is self contained within the transducer, and requires no injection of gas. There are no material replenishment requirements. The resonant frequency and hence, performance, is completely stable with depth. Reliability is increased because there are no active sensors or components. In addition, the system described herein provides for improved heat dissipation within the moving coil assembly. This allows for increased output. Moreover, the transducer performance is increased without increase in harmonic distortion, while transducer bandwidth remains essentially unaffected.

Those skilled in the art will know or be able to ascertain using no more than routine experimentation, many equivalents to the embodiments and practices described herein. For example, the pressure compensation systems described herein can be employed in other applications such as pressure compensation for moving mechanical assemblies, and the transducer assemblies described can be employed as individual components, or arranged as an array of transducers. It will also be understood that the systems described herein provide advantages over the prior art including increased safety, and reduced cost.

Accordingly, it will be understood that the invention is not to be limited to the embodiments disclosed herein, but is to be understood from the following claims, which are to be interpreted as broadly as allowed under the law.

What is claimed is:

1. Apparatus for providing pressure compensation for a transducer assembly having a moving coil and a diaphragm in contact with an operating environment, comprising:

a housing having an interior cavity capable of being filled with liquid and dimensioned for receiving and enclosing the moving coil of the transducer assembly, a resilient bladder having a first portion in communication with the operating environment and a second portion in communication with a liquid reservoir maintained within the housing, a filter coupled to the liquid reservoir and capable of attenuating acoustic energy propagating at selected frequencies within the liquid reservoir, and a liquid passage extending between the fluid reservoir and the interior cavity, whereby a pressure change in the operating environment acts on the resilient bladder and for being communicated through the liquid reservoir and the liquid passage to adjust the pressure within the interior cavity.

2. Apparatus according to claim 1, further comprising a compressible body disposed within the interior cavity.

3. Apparatus according to claim 1, further comprising a slotted cylinder disposed within the interior cavity.

4. Apparatus according to claim 1, further comprising a compressible bladder disposed within the interior cavity.

5. Apparatus according to claim 1, further comprising a compliant disk assembly having a bladder filled with a gas capable of being compressed in response to a change in pressure within the interior cavity.

6. Apparatus according to claim 5, wherein the compliant disk assembly comprises a plurality of bladders filled with a compressible gas capable of being compressed in response to a change in pressure within the interior cavity.

7. Apparatus according to claim 1, wherein the filter comprises a conduit coupled between the liquid reservoir and the interior cavity and having an interior passage for forming the liquid passage extending there between, and being dimensioned for resisting transmission of acoustic energy at selected frequencies between the liquid reservoir and the interior cavity.

8. Apparatus according to claim 1, wherein the liquid passage includes a conduit coupled between the reservoir and the interior cavity and dimensioned to allow liquid to pass at a rate selected as a function of the rate of pressure change of the operating environment.

9. Apparatus according to claim 1, wherein the housing comprises a body having a mass selected to resist vibration at selected frequencies.

10. Apparatus according to claim 1, wherein the housing includes a support rim for mounting to the transducer assembly.

11. Apparatus according to claim 1, wherein the housing includes a mounting rim for allowing the housing to be removeably and replaceably mounted to a surface.

12. A modular moving coil transducer having pressure compensation for adjusting to pressure changes in an operating environment, comprising:

a transducer assembly having a moving coil and a diaphragm, a housing having a liquid-filled interior cavity enclosing the moving coil of the transducer assembly, and having a resilient bladder disposed between the operating environment and a liquid reservoir maintained within the housing and being capable of deforming in response to a pressure change in the operating environment, a filter coupled to the liquid reservoir and capable of attenuating acoustic energy propagating at selected frequencies within the liquid reservoir, and a liquid passage extending between the liquid reservoir and the interior cavity, whereby a pressure change in the operating environment acts on the resilient bladder for being communicated through the liquid reservoir and the liquid passage to adjust the pressure within the interior cavity.

13. Apparatus according to claim 12, further comprising a compressible body disposed within the interior cavity.

14. Apparatus according to claim 12, further comprising a compliant disk assembly capable of being compressed in response to a change in pressure within the interior cavity.

15. Apparatus according to claim 12, wherein the filter comprises a conduit coupled between the liquid reservoir and the interior cavity and having an interior passage for forming the liquid passage extending there between, and being dimensioned for resisting transmission of acoustic energy at selected frequencies between the liquid reservoir and the interior cavity.

16. Apparatus according to claim 12, wherein the liquid passage includes a conduit coupled between the liquid reservoir and the interior cavity and dimensioned to allow liquid to pass at a rate selected as a function of the rate of pressure change of the operating environment.

17. Apparatus according to claim 12, wherein the housing includes a mounting rim for allowing the housing to be removeably and replaceably mounted to a surface.

18. A target underwater vehicle capable of ascending and descending to different depths within a fluid environment, comprising a submersible body having a sidewall with a port for receiving a transducer assembly, and a modular transducer assembly mounted within the port, and having a moving coil projector including a moving coil and a diaphragm, a housing having a liquid-filled interior cavity enclosing the moving coil, and having a resilient bladder disposed between the fluid environment and a liquid reservoir maintained within the housing, a filter coupled to the liquid reservoir and capable of attenuating acoustic energy propagating at selected frequencies within the liquid reservoir, and a liquid passage extending between the liquid reservoir and the liquid-filled interior cavity, whereby a pressure change arising from a change in depth within the fluid environment acts on the resilient bladder to communicate the pressure change through the liquid reservoir and the liquid passage to adjust the pressure within the interior cavity.

* * * * *